US010111493B2

(12) United States Patent
O'Connor

(10) Patent No.: US 10,111,493 B2
(45) **Date of Patent: *Oct. 30, 2018**

(54) ARTICLE OF FOOTWEAR WITH RIBBED FOOTBED

(71) Applicant: NIKE, Inc., Beaverton, OR (US)

(72) Inventor: Kelly A. O'Connor, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 200 days.

This patent is subject to a terminal disclaimer.

(21) Appl. No.: 14/940,989

(22) Filed: Nov. 13, 2015

(65) Prior Publication Data

US 2016/0135538 A1 May 19, 2016

Related U.S. Application Data

(63) Continuation of application No. 12/987,325, filed on Jan. 10, 2011, now Pat. No. 9,210,965.

(51) Int. Cl.
*A43B 3/10* (2006.01)
*A43B 5/08* (2006.01)
(Continued)

(52) U.S. Cl.
CPC ..... *A43B 13/186* (2013.01); *A43B 3/108* (2013.01); *A43B 3/128* (2013.01); *A43B 5/08* (2013.01);
(Continued)

(58) Field of Classification Search
CPC ..... A43B 3/108; A43B 5/08; A43B 7/141; A43B 7/146; A43B 13/141; A43B 13/223; A43B 13/226
(Continued)

(56) References Cited

U.S. PATENT DOCUMENTS 363,377 A 5/1887 Faye, Jr.
1,433,309 A 10/1922 Stimpson
(Continued)

FOREIGN PATENT DOCUMENTS

CA 2357521 A1 2/2003
DE 10314606 A1 10/2004
(Continued)

OTHER PUBLICATIONS

International Preliminary Report on Patentability and Written Opinion for Application No. PCT/US2012/020421, dated Jul. 18, 2013.
(Continued)

*Primary Examiner* — Sharon M Prange
(74) *Attorney, Agent, or Firm* — Honigman Miller Schwartz and Cohn LLP; Matthew H. Szalach; Jonathan P. O'Brien

(57) ABSTRACT

An article of footwear configured for prolonged casual and non-casual uses having an upper configured for easy installation and removal of the article of footwear with or without the use of fasteners, a sole, and a substantially continuous series of alternating ribs and grooves on a footbed of the sole extending from a forefoot region to a heel region. The ribs and grooves have base widths that are greater in an arch region of the footbed than the forefoot and heel regions of the footbed. The series of alternating transverse ribs and grooves are oriented from a lateral side region of the footbed to a medial side region of the footbed.

16 Claims, 13 Drawing Sheets

(51) Int. Cl.

| | |
|---|---|
| ***A43B 7/14*** | (2006.01) |
| ***A43B 13/14*** | (2006.01) |
| ***A43B 13/18*** | (2006.01) |
| ***A43B 3/12*** | (2006.01) |

(52) U.S. Cl.
CPC ..... *A43B 7/14* (2013.01); *A43B 7/141* (2013.01); *A43B 7/142* (2013.01); *A43B 7/146* (2013.01); *A43B 7/149* (2013.01); *A43B 13/141* (2013.01)

(58) Field of Classification Search
USPC ..... 36/11.5, 25 R, 59 C, 91, 102, 141
See application file for complete search history.

(56) References Cited

U.S. PATENT DOCUMENTS

| | | | |
|---|---|---|---|
| 1,724,450 | A | 8/1929 | Callahan |
| 2,075,229 | A | 3/1937 | Rose |
| 2,185,762 | A | 1/1940 | Cox |
| 2,692,401 | A | 10/1954 | Stritter |
| 2,734,286 | A | 2/1956 | Anson |
| 2,926,435 | A | 3/1960 | Maling |
| 3,160,963 | A | 12/1964 | Aaskov |
| 3,595,244 | A | 7/1971 | Richard |
| 3,722,113 | A | 3/1973 | Birkenstock |
| 3,757,774 | A | 9/1973 | Hatuno |
| 4,075,772 | A | 2/1978 | Sicurella |
| 4,268,980 | A | 5/1981 | Gudas |
| D270,964 | S | 10/1983 | Archibald |
| D275,145 | S | 8/1984 | Glatz |
| D278,571 | S | 4/1985 | Eber |
| 4,525,940 | A | 7/1985 | Mochizuki |
| 4,570,362 | A | 2/1986 | Vermonet |
| 4,598,484 | A | 7/1986 | Ma |
| 4,617,745 | A | 10/1986 | Batra |
| D290,900 | S | 7/1987 | Schornstein et al. |
| 4,747,219 | A | 5/1988 | Ammendolea |
| 4,910,882 | A | 3/1990 | Goeller |
| 4,910,887 | A | 3/1990 | Turner et al. |
| 4,939,851 | A | 7/1990 | Miller |
| 4,972,610 | A | 11/1990 | Tong |
| 5,014,448 | A | 5/1991 | Perrone |
| 5,035,068 | A | 7/1991 | Biasi |
| 5,165,183 | A | 11/1992 | Huang |
| 5,322,056 | A | 6/1994 | Menghi et al. |
| 5,400,526 | A | 3/1995 | Sessa |
| D373,013 | S | 8/1996 | Rosetta |
| 5,839,208 | A | 11/1998 | Huang |
| 6,003,246 | A | 12/1999 | Pan |
| 6,014,821 | A | 1/2000 | Yaw |
| 6,701,640 | B2 | 3/2004 | Nakano |
| 6,871,420 | B2 | 3/2005 | Shikhashvili |
| 6,874,252 | B2 | 4/2005 | Nakano |
| D505,537 | S | 5/2005 | Friedman |
| 6,898,871 | B2 | 5/2005 | Herman |
| 7,055,265 | B1 | 6/2006 | Bathum et al. |
| D532,190 | S | 11/2006 | Scheurer |
| 7,310,894 | B1 | 12/2007 | Schwarzman et al. |
| 7,367,142 | B2 | 5/2008 | Ferniani et al. |
| 7,392,605 | B2 * | 7/2008 | Hatfield ..... A43B 3/0057 36/102 |
| D577,882 | S | 10/2008 | Little |
| 7,614,167 | B2 | 11/2009 | Klavano |
| D606,292 | S | 12/2009 | Ong |
| 7,703,219 | B2 | 4/2010 | Beck |
| 7,762,008 | B1 | 7/2010 | Clark et al. |
| 8,109,012 | B2 | 2/2012 | Sarantakos et al. |
| 9,210,965 | B2 | 12/2015 | O'Connor |
| 2001/0025432 | A1 | 10/2001 | Contreras et al. |
| 2002/0088140 | A1 | 7/2002 | Wang et al. |
| 2003/0136023 | A1 | 7/2003 | Chen |
| 2005/0120587 | A1 | 6/2005 | Helton et al. |
| 2005/0217141 | A1 | 10/2005 | Cobian |
| 2005/0262726 | A1 | 12/2005 | Ferniani et al. |
| 2007/0240333 | A1 | 10/2007 | Le et al. |
| 2007/0245592 | A1 | 10/2007 | Yamaguchi et al. |
| 2008/0052966 | A1 | 3/2008 | Pan |
| 2010/0088928 | A1 | 4/2010 | Sarantakos et al. |

FOREIGN PATENT DOCUMENTS

| | | | |
|---|---|---|---|
| EP | 0037462 | A1 | 10/1981 |
| JP | 2001137002 | A | 5/2001 |

OTHER PUBLICATIONS

International Search Report and Written Opinion for Application No. PCT/US2012/020421, dated May 23, 2012.
European Patent Office, Communication pursuant to Article 94(3) EPC for Application No. 12704940.1, dated Nov. 16, 2016.

* cited by examiner

ARTICLE OF FOOTWEAR WITH RIBBED FOOTBED

CROSS-REFERENCE TO RELATED APPLICATIONS

This application is a continuation of U.S. patent application Ser. No. 12/987,325, filed on Jan. 10, 2011 and published as U.S. Patent Application Publication No. 2012/0174439 on Jul. 12, 2012, entitled "Article of Footwear with Ribbed Footbed," which is incorporated herein by reference in its entirety.

BACKGROUND OF THE INVENTION

1. Field of the Invention

The present invention relates generally to an article of footwear having a ribbed footbed, and more particularly to an article of footwear configured with transverse ribs of varying geometry on the footbed.

2. Description of Related Art

Increasingly, people wear articles of footwear configured for casual use, such as sandals and shower shoes. These articles of footwear are typically partially open, are easy to put on and take off, and they can be used in and around wet environments. For example, many people wear these types of footwear in casual settings, such as around the house and in informal environments like the beach or yard, including in and around water. These types of footwear are typically worn for short periods and are used on surfaces that are uneven, such as on grassy, sandy or graveled surfaces.

It is becoming common for people to extend their use of these articles of footwear to less casual environments, such as at stores and public places, particularly during warm seasons or in warm climates, and to use them for extended periods in the less casual environments as well as in the casual environments. Conventional articles of footwear of this type have soft soles that are comfortable for short-term casual use and that are flexible for traversing uneven surfaces typically encountered in casual environments, and they include raised features and/or channels in the footbed to accommodate use in an around water. While these types of articles of footwear can protect the foot from contact with undesirable surfaces and can accommodate wet environments, they fail to provide appropriate support for the foot during prolonged use.

Articles of footwear for use in casual environments including use in or around water have been proposed that include projections in the footbed of varying heights, which can elevate the foot from the footbed and provide drainage to accommodate use in and around wet environments. For example U.S. Pat. No. 3,722,113 to Karl Birkenstock discloses an article of footwear having projections extending substantially normal away from the footbed that can be of different lengths. Another example includes U.S. Pat. No. D505,537 to Stacey Friedman, which discloses an article of footwear for use in casual environments having large ribs extending laterally across the footbed.

While there are articles of footwear for use in casual environments having projections extending from the footbed, there exists a need in the art for features that provide appropriate support for extended use in casual and less casual environments.

SUMMARY OF THE INVENTION

An article of footwear includes an upper, a sole, and a series of alternating transverse ribs and grooves on a footbed of the sole. The grooves are formed between of adjacent ribs. The article of footwear can be configured for prolonged casual and non-casual uses and the upper can be configured for easy installation and removal on a foot with or without the use of fasteners.

In one configuration, the series of alternating ribs and grooves are substantially continuous and extend from a forefoot region to a heel region of the footbed. Each of the ribs and grooves have base widths, which are greater in an arch region of the footbed than in the forefoot and heel regions of the footbed. The series of alternating transverse ribs and grooves are oriented from a lateral side region of the footbed to a medial side region of the footbed.

In another configuration, an article of footwear includes a sole having an outsole and a footbed element configured to support a foot away from the outsole, and a plurality of substantially transverse ribs formed on the footbed element so that a groove is disposed between adjacent ones of the ribs. A forefoot set of the substantially transverse ribs are disposed at a forefoot region of the footbed element that have a first geometry including a first rib height, a first base width and a first spacing between adjacent ribs. A heel set of the substantially transverse ribs is disposed at a heel region of the footbed element and has a second geometry including a second rib height, a second base width and a second spacing between adjacent ribs.

An arch set of the substantially transverse ribs are disposed at an arch region of the footbed element and has a third geometry that differs from the first and second geometries. The third geometry can include a third rib height, a third base width and a third spacing between adjacent ribs. The third rib height, the third base width and the third spacing in the arch region of the footbed can be greater than the first and second rib heights, the first and second base widths, and the first and second spacings between adjacent ribs.

In a further configuration, an article of footwear includes a footbed having a series of alternating substantially transverse ribs and grooves in which the substantially transverse ribs are configured to resist bending of the sole along longitudinal axes generally oriented from a forefoot end portion of the sole to a heel end portion of the sole, and the grooves are configured to permit bending of the sole along transverse axes generally oriented from a lateral edge portion of the sole to a medial edge portion of the sole. In addition, recesses can be formed in the outsole that further encourage bending along the transverse axes.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION OF THE DRAWINGS

Figure 1:
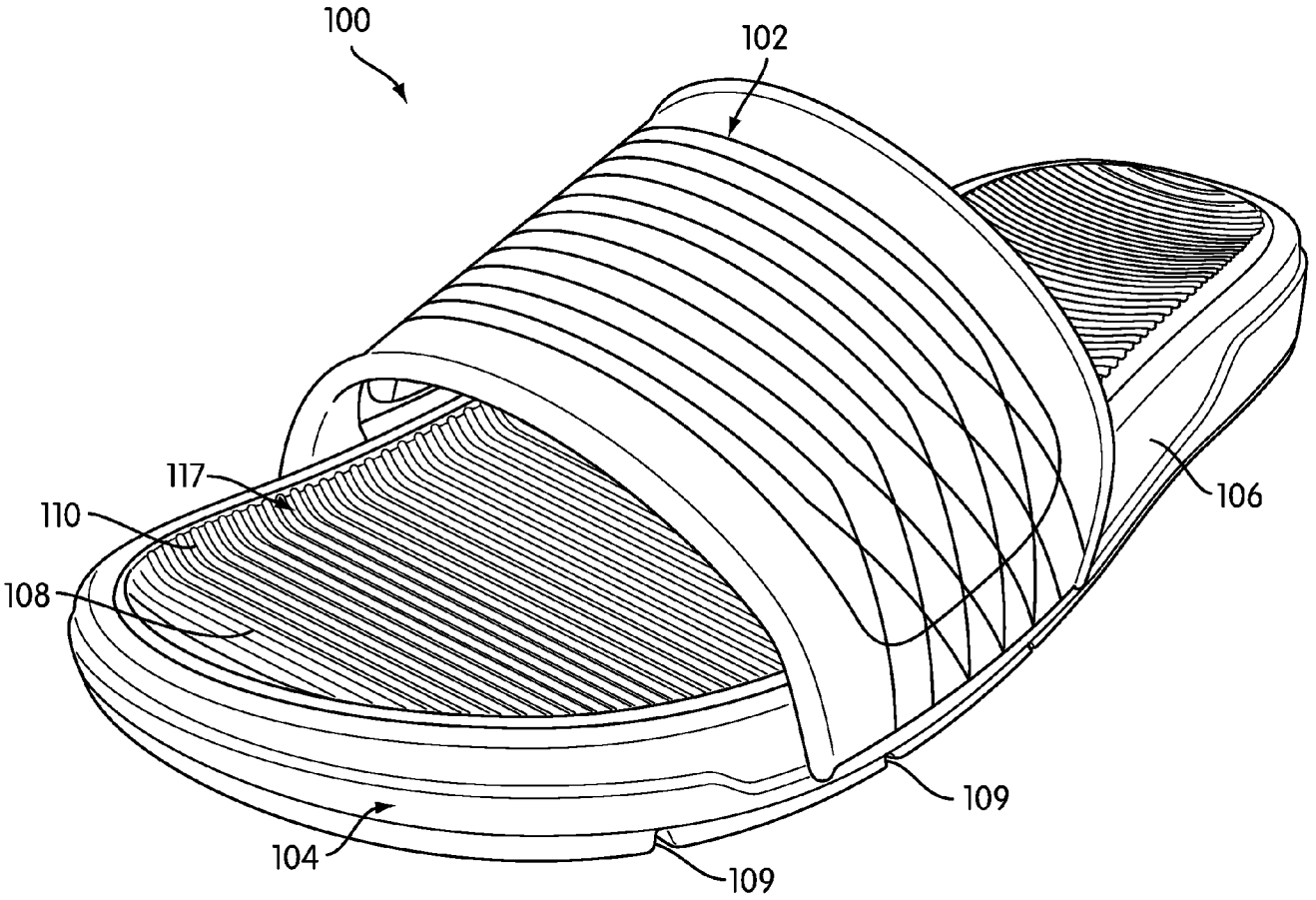
FIG. 1 is a front lateral perspective view of an example article of footwear having a ribbed footbed.
Figure 2:
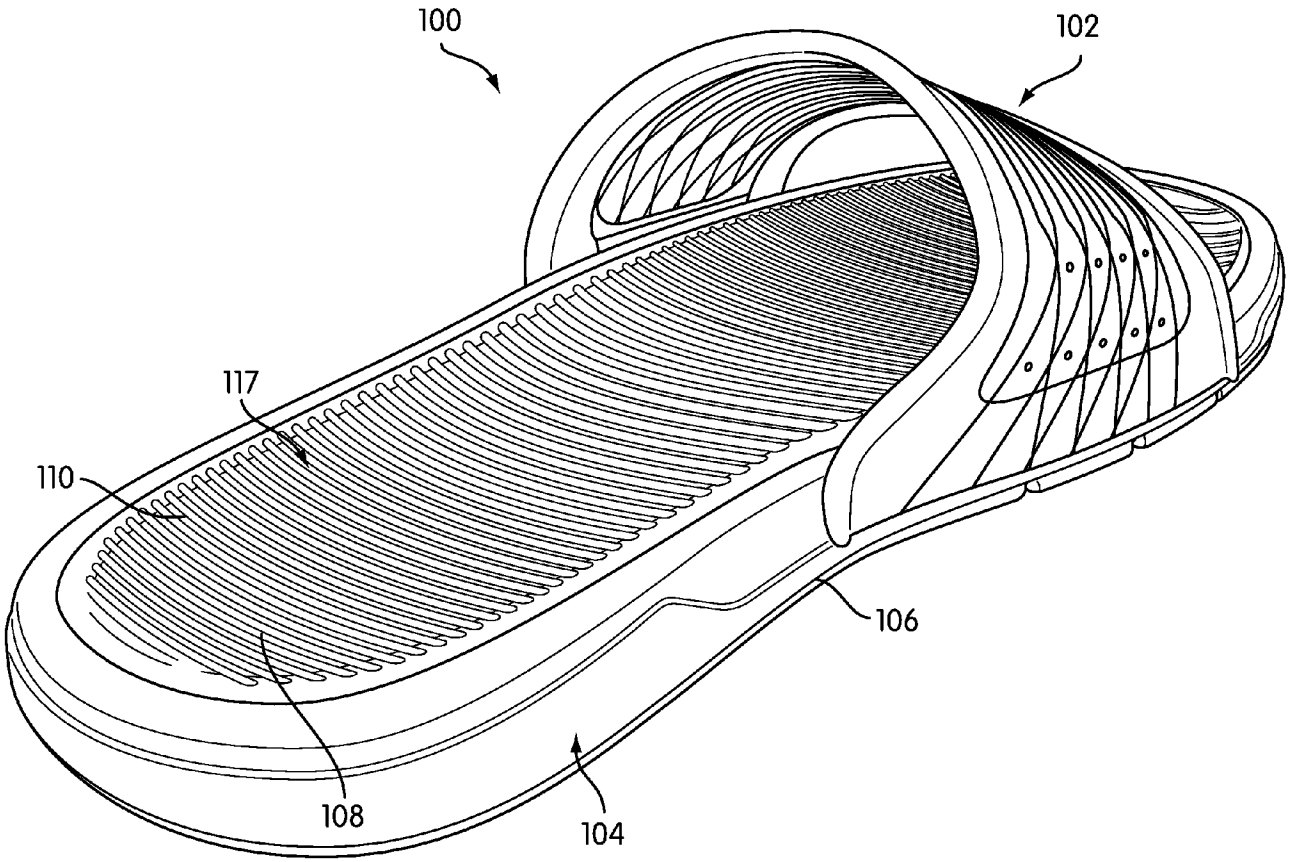
FIG. 2 is a rear medial perspective view of an example article of footwear having a ribbed footbed.
Figure 3:
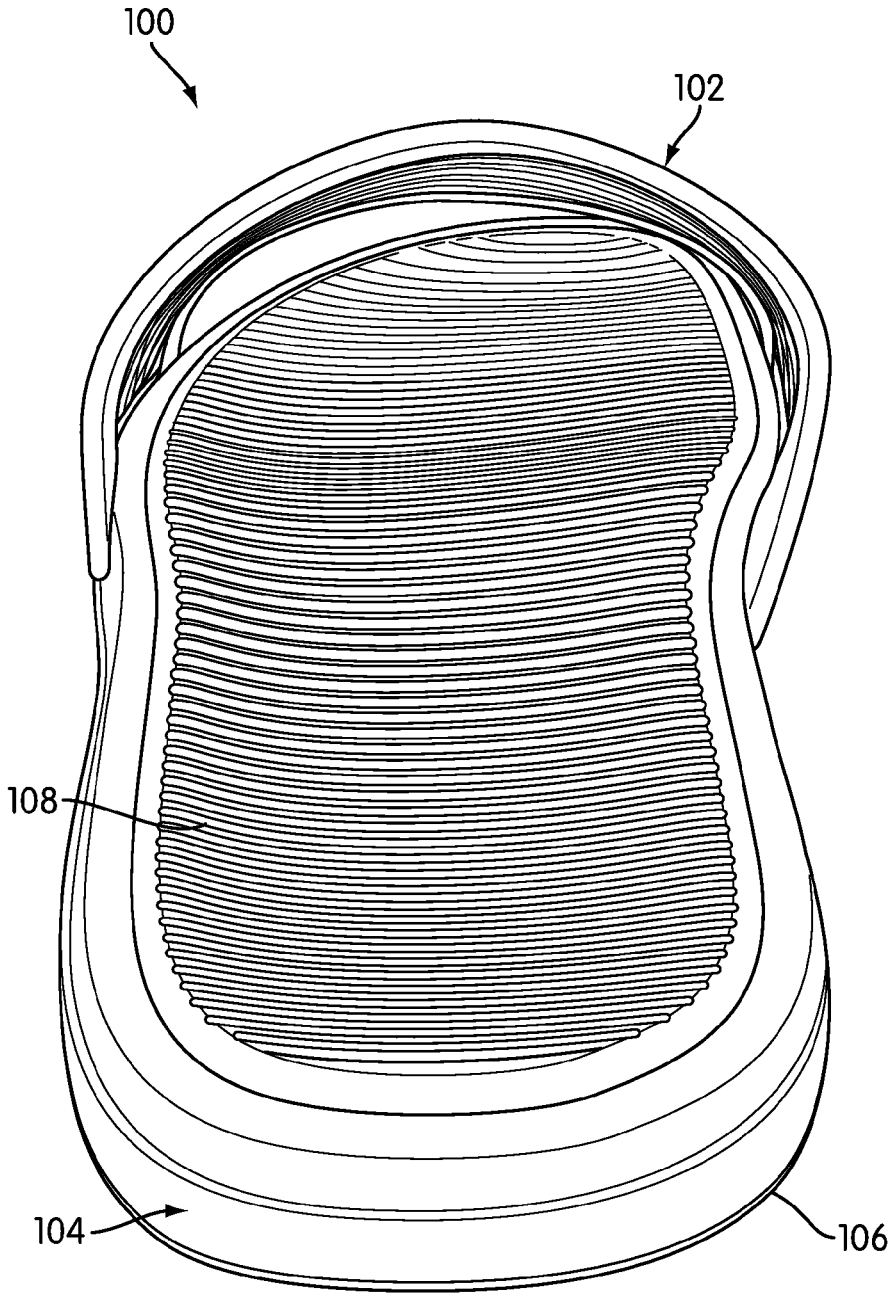
FIG. 3 is a rear perspective view of an example article of footwear having a ribbed footbed.
Figure 4:
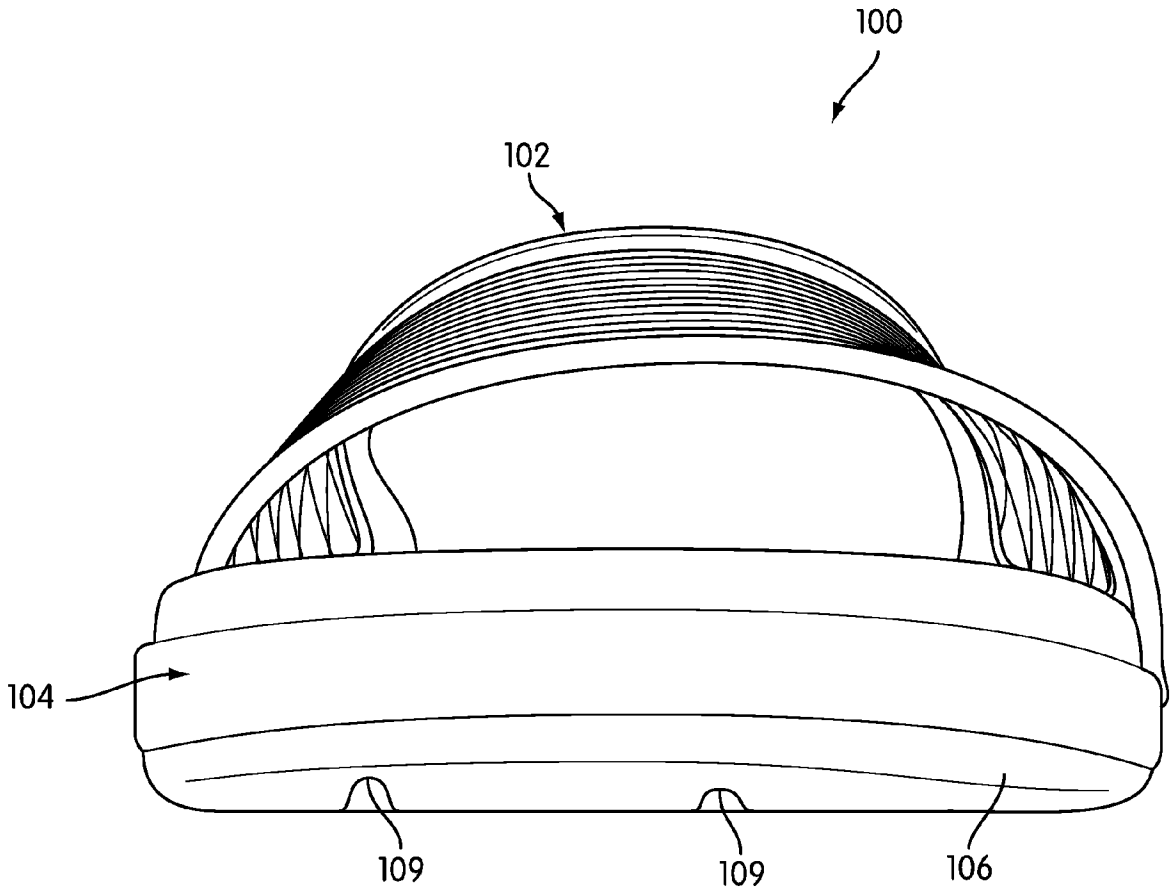
FIG. 4 is a front view of an example article of footwear having a ribbed footbed.

An article of footwear for casual and less-casual uses is provided that includes features for providing stability and impact-attenuation to the foot during prolonged use in a variety of environments. The following discussion and accompanying figures disclose an article of footwear and, more particularly, a sole structure of the footwear. Concepts related to the sole structure are disclosed with reference to footwear having a configuration that is suitable for use in casual environments, including in or around water, and in less-casual environments, such as in public buildings and walking on hard surfaces. The sole structure is not limited to such footwear, however, and can be utilized with a wide range of footwear styles. An individual skilled in the relevant art will appreciate, therefore, that the concepts disclosed herein apply to a wide variety of footwear styles, in addition to the specific style discussed in the following material and depicted in the accompanying figures.

The drawings will generally be discussed using common spatial, geometric and directional references. However, with respect to particular objects being discussed, such as an article of footwear, the comments will generally apply to a typical frame of reference for use of the article of footwear. For instance, anatomical references, such as the directional terms medial and lateral, generally imply the common use of those terms with respect to human anatomy and, with respect to an object like an article of footwear, refer to typical positioning of the article of footwear on a user's foot when worn. As such, the term medial generally indicates a direction toward the midline of the user's body when wearing an article of footwear and the term lateral generally indicates a direction away from the midline.

Non-anatomical references are generally applicable to the article of footwear or other object of discussion as typically oriented during use. For instance, the term bottom when applied to an article of footwear usually refers to a region of the article proximate the ground during use (e.g., outsole region).

Object-specific references, such as the terms longitudinal and transverse, generally apply to the frame of reference for the object or portion of an object being discussed and its orientation in the figure. For example, if a sole of an article of footwear was being discussed and was shown in an orientation of typical use (e.g., outsole oriented downward in the drawing sheet), the term lower would indicate toward the bottom of the drawing (e.g., in the direction of the outsole), the term longitudinal would usually refer to its longest direction (e.g., heel portion to forefoot portion of the sole), and the term transverse would usually refer to a cross-direction from longitude (e.g., across the width of the sole).

The figures show configurations of an article of footwear 100 provided with a ribbed footbed. Only one article of footwear 100 is shown and discussed herein, although a mirror image article of footwear 100 can be provided to form a pair for use by a wearer. Article of footwear 100 generally includes an upper 102 associated with a sole 104.

Upper 102 can be any type of upper known in the art including uppers for generally casual articles of footwear, such as sandals, which can permit simple installation and removal of the article of footwear. In some configurations, upper 102 can be configured to allow for installation, use and removal of the article of footwear without the use of fastening mechanisms, such as laces, straps, hook and loop fasteners, buckles, etc. Upper 102 is depicted as having a substantially conventional configuration incorporating a plurality of material elements (e.g., textiles, foam, leather, and synthetic leather) that are stitched or adhesively bonded together to form an interior void for securely and comfortably receiving a foot. Given that various aspects of the present application primarily relate to sole 104, upper 102 can exhibit the general configuration discussed above or the general configuration of practically any other conventional or non-conventional upper. Accordingly, the structure of upper 102 utilized with sole 104 or variants thereof can vary significantly.

In the example configuration shown, upper 102 is configured so that a user can slide a foot into upper 102. Upper 102 can extend entirely across sole 104 in a transverse direction and only partially along sole 104 in a longitudinal direction. In other configurations, upper 102 can have other arrangements, such as providing a partition or partitions between the toes, providing straps, or by having upper 102 cover a greater portion of the wearer's foot.

Upper 102 can be made of any material known in the art including a water-resistant material such as vinyl, plastic, or the like. In some configurations, upper 102 can be made from a porous material coated or sealed with a water-resistant material.

Upper 102 is generally associated with sole 104. In some configurations, upper 102 can be fixedly or removably attached to sole 104. Upper 102 can be associated with sole 104 using any method known in the art, such as by welding, stitching, co-molding, over-molding, joined with an adhesive, or joined with a mechanical fastener. Mechanical fasteners can include a hook and loop fastener, snaps, buckles, zippers, or the like. In the configuration shown in the figures, upper 102 is attached to sole 104 on the periphery of sole 104. In other configurations, upper 102 can be attached to sole 104 in other locations.

Sole 104 generally includes an outsole 106 that forms the main body of sole 104 and a ribbed element 108 for supporting the wearer's foot. Outsole 106 can be made of any material typically used for ground-engaging surfaces for articles of footwear, such as rubber, silicone, or the like. Outsole 106 can include surface texture or treads 109 for traction between outsole 106 and the ground. Outsole 106 can be made as a single layer or can be made of multiple layers. In one configuration, outsole 106 can be molded from a single material as a unitary element. In other configurations, outsole 106 can include multiple layers associated with each other using any method known in the art, such as with an adhesive, by welding, or the like.

Article of footwear 100 can include provisions that lift a wearer's foot away from outsole 106 while providing various advantageous features, such as imparting lateral structural support to resist transverse bending across the sole, encouraging bending in desired directions along the length of the sole, and providing impact absorption and attenuation to the foot during use. In some configurations, these provisions include lateral protrusions or ribs 110 that extend away from outsole 106.

Figure 9:
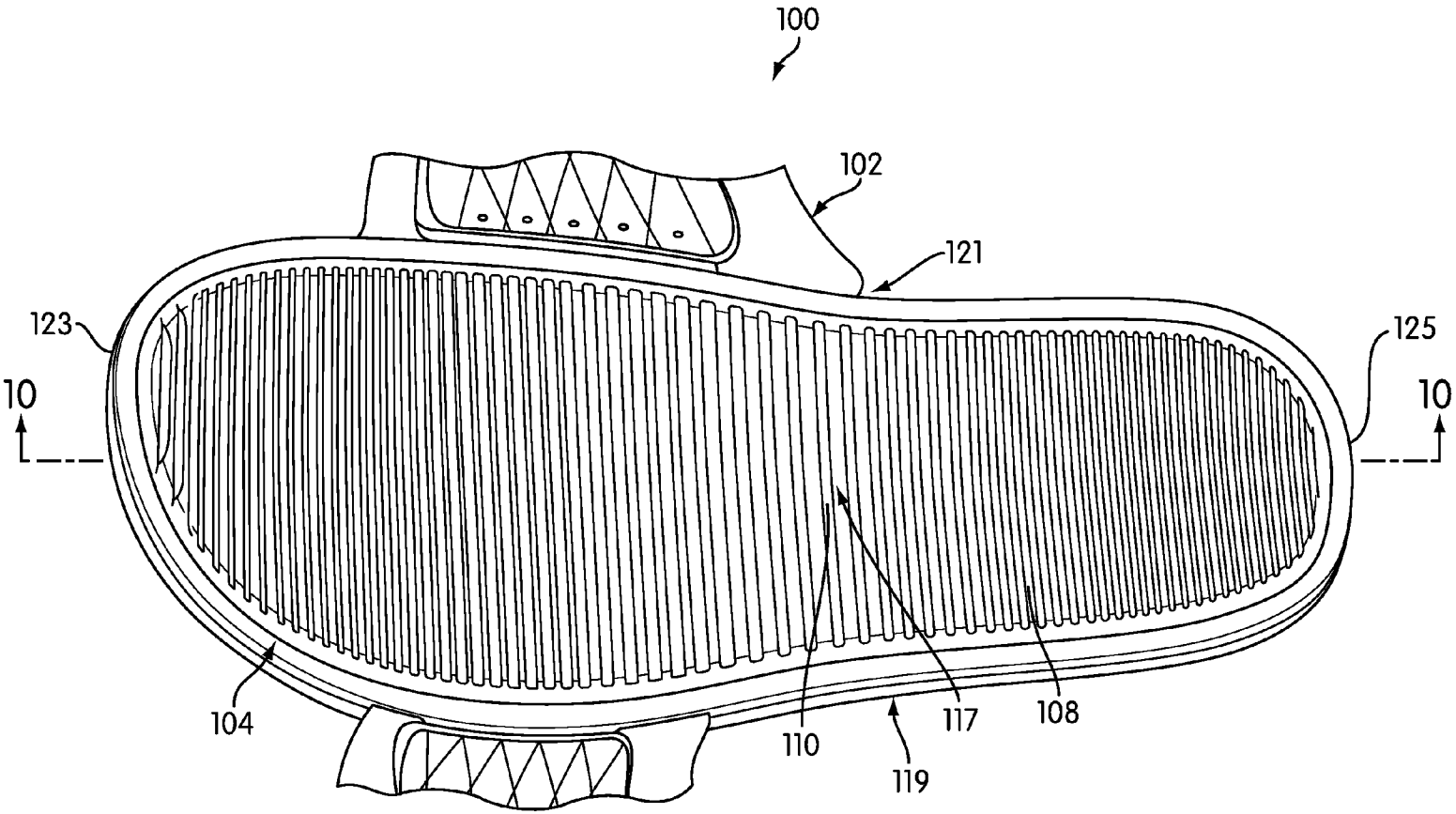
FIG. 9 is a top view of the article of footwear of FIG. 8 shown with the upper removed.
Figure 10:
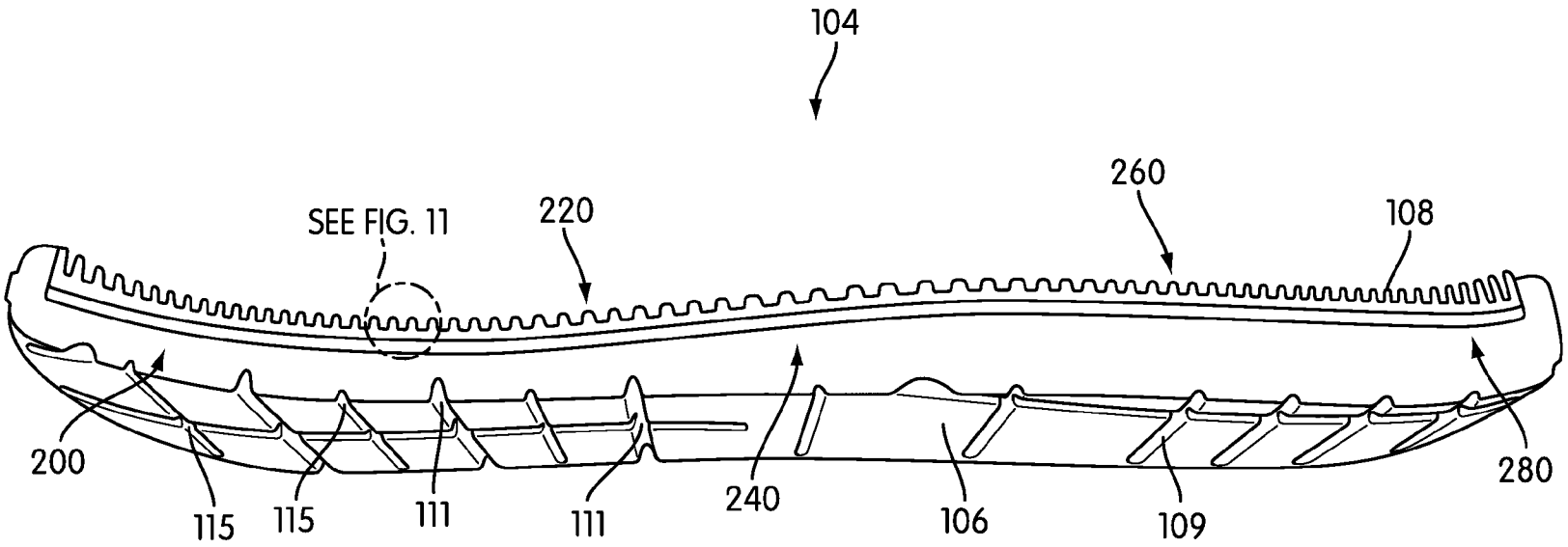
FIG. 10 shows a cross-section of the lower portion of the article of footwear of FIG. 9 taken along line 10-10 of FIG. 9.
Figure 11:
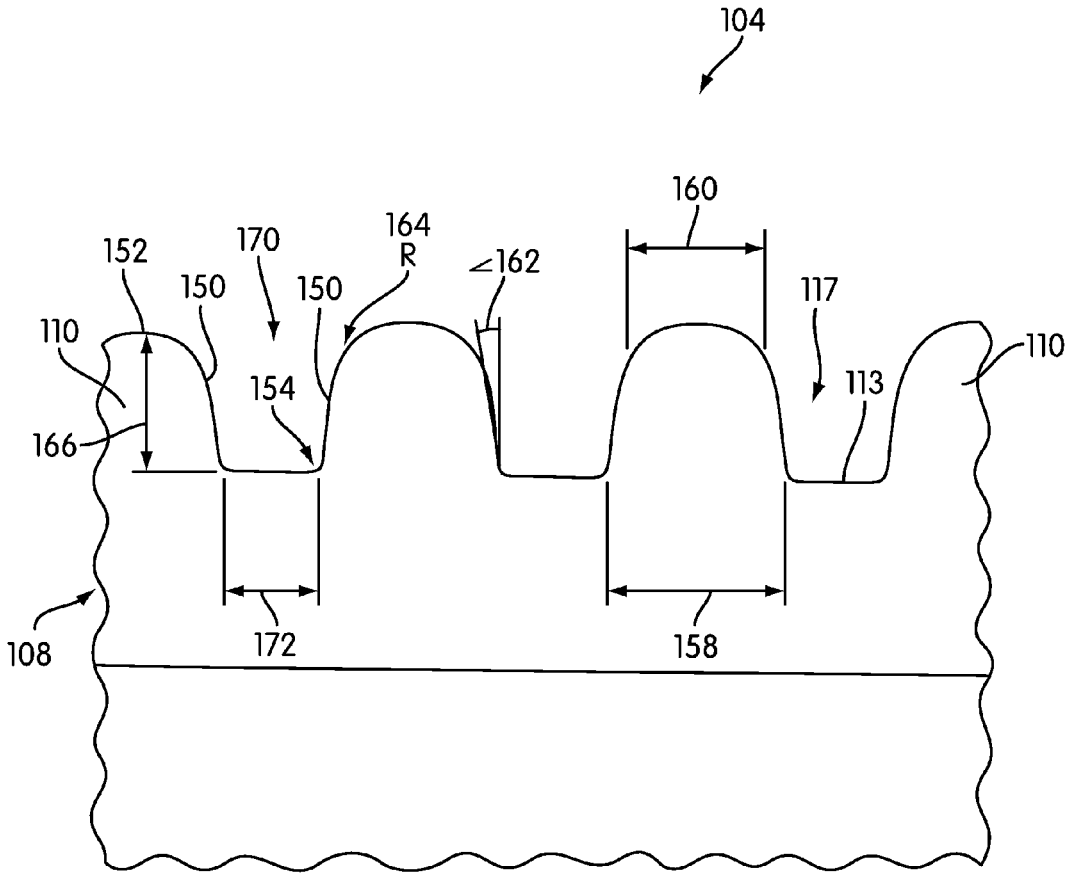
FIG. 11 is a close view of the cross-section of FIG. 10 showing a portion of the ribbed footbed of the article of footwear of FIG. 8.

As shown in FIGS. 9-11, article of footwear 100 can be provided with a series of alternating transverse ribs 110 and grooves 117. Ribs 110 extend away from a footbed base 113 of ribbed element 108 so that the wearer's foot generally rests on ribs 110 during use and is supported away from footbed base 113 and outsole 106. As shown in FIG. 9, ribs 110 can be oriented in a generally transverse arrangement to extend across the footbed between a lateral side portion 119 and a medial side portion 121 of the sole 104. Ribs 110 can be generally parallel with one another. In some configurations, ribs 110 and grooves 117 can extend from a forward forefoot portion 123 of sole 104 to a rearward heel portion 125 of sole 104 in an alternating arrangement to form a generally continuous series of ribs and grooves in the footbed.

In some configurations, ribs 110 can be formed as part of a ribbed element 108. Ribbed element 108 can be a unitary element that extends at least partially along the length of outsole 106. In some configurations, ribbed element 108 can be substantially co-extensive with outsole 106. In other configurations, ribbed element 108 can extend only along a portion of outsole 106. Ribbed element 108 can be formed separately from outsole 106 and associated with outsole 106 using any method known in the art, such as by over-molding or with an adhesive. Examples of various types of adhesives that could be used include, but are not limited to, natural adhesives, synthetic adhesives, drying adhesives, contact adhesives, hot melt adhesives (such as thermoplastic adhesives) and pressure sensitive adhesives.

In some configurations, ribbed element 108 can be made from the same material as outsole 106. In such configurations, ribbed element 108 can be co-formed with outsole 106. In other configurations, ribbed element 108 can be formed from a different material than outsole 106. In some configurations, ribbed element 108 can be made from a stiffer material than outsole 106 so that ribs 110 resist bending when a wearer's foot applies pressure to ribs 110. In some configurations, ribbed element 108 can be made from a plurality of materials, such as a relatively stiff material coated or covered with a softer material. In these configurations, ribs 110 resist bending due to the stiff inner material while the foot of the wearer is cushioned against the softer outer material.

As shown in FIG. 11, ribs 110 can be formed as spaced apart elongated elements 110 having a pair of walls 150 on opposite sides, a top portion 152 and a base portion 154 at a lower end proximate the footbed base 113. Each wall 150 of a pair of walls for a particular rib 110 can be inclined toward each other as they extend away from footbed base 113 such that the corresponding rib 110 has a base width 158 proximate footbed base 113 that is greater than its upper width 160 proximate top portion 152. Each rib 110 can have a height 166 from footbed base 113 to its top portion 152, which can vary as desired for ribs throughout ribbed element 108 and along the length of the same rib 110. The opposite walls 150 for a rib 110 can be inclined toward each other at an angle 162 or a radius 164 to provide a generally tapered cross-sectional shape for the rib. Whether a rib is tapered and, if so, the amount of tapering, can differ for various ribs at differing locations along ribbed element 108 or even at differing portions along the length of the same rib.

Each of the grooves 117 can be formed from the space between opposing walls 151 of adjacent ribs 110 along with the footbed base 113 and an open top region 170. Each of the grooves 117 can have a base width 172 at a bottom portion proximate footbed base 113. Grooves 117 can be uniform in size along the length and width of sole 104. In addition, as discussed further along with FIGS. 12-15, grooves 117 and ribs 110 can have varying geometries, such as differing widths, heights, spacings, angles, curvatures, etc. to provide various advantageous features.

Figure 12:
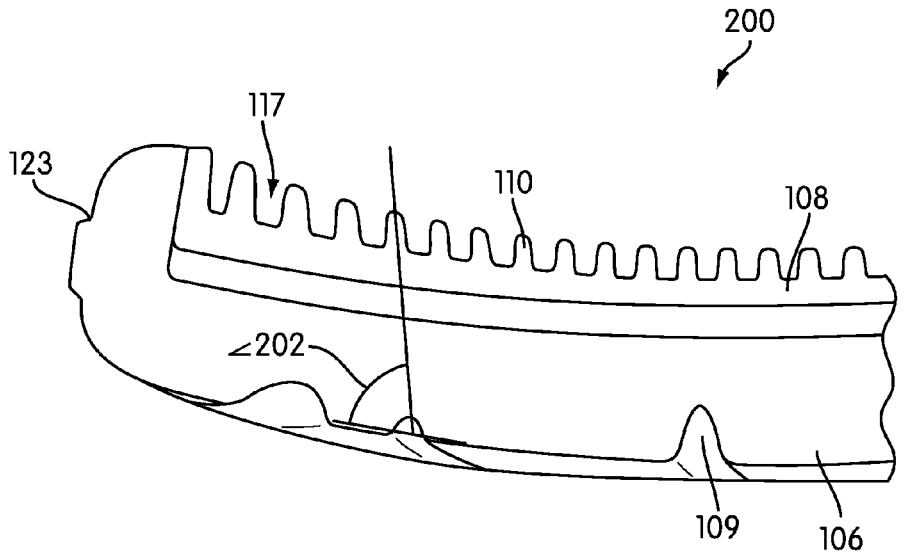
FIGS. 12-15 are close views of portions of the cross-sectional view of FIG. 10 as indicated in FIG. 10.

Referring now to FIGS. 9, 10 and 12, a forefoot portion 200 of ribbed element 108 is disposed in a forward portion of ribbed element 108 in a region generally corresponding with the user's forefoot during use. As shown in FIG. 12, the heights 166 of ribs 110 can decrease moving rearward along footbed element 108 from forward forefoot portion 123. Further, base widths 172 of the grooves 117 interposed between ribs in forefoot portion 200 can also decrease moving from forward forefoot portion 123 rearward along footbed element 108. As such, the spacing between ribs in forefoot portion 200 can decrease moving rearward along footbed element 108 from foreword forefoot portion 123. In addition, the angle of inclination 202 of the ribs can increase moving rearward along footbed element 108 from ribs being generally angled forward to ribs that are generally oriented perpendicular to the outsole 106 in an area below the ball of the user's forefoot. Geometric changes to the ribs and grooves along the footbed can occur gradually as desired to provide a ribbed footbed having smooth geometric transitions for the foot.

Such a configuration of comparatively shorter, closer spaced, and generally perpendicular or slightly forwardly angled ribs 110 beneath the ball of the user's foot can provide various advantages—particularly for long term use of the article of footwear. For example, ribs of shorter height can have greater column strength than taller ribs and can better support the foot and attenuate impacts at a position of concentrated weight-bearing below the ball of the user's foot. Likewise, closely spaced, thinner ribs at the same location can provide a tightly-packed bed of support ribs for improved impact attenuation and support beneath the ball of the foot. Slightly angling the ribs forward beneath the ball of the foot and angling the ribs forward to a greater degree proximate the forward forefoot portion 123 beneath the user's toes can provide improved support when the user flexes the foot to push forward while walking.

Figure 15:
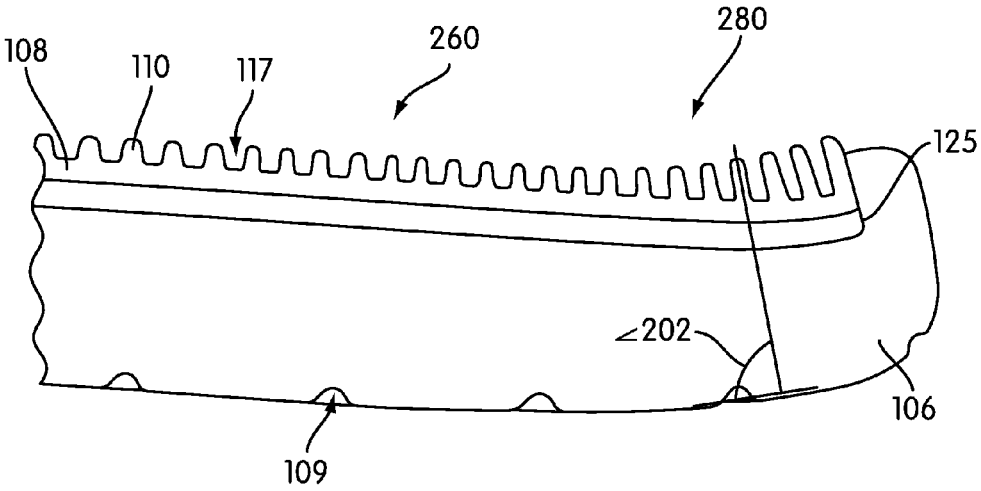

Referring now to FIGS. 9, 10 and 15, a heel portion 280 of ribbed element 108 is disposed in a rearward portion of ribbed element 108 in a region generally corresponding with the user's heel during use. As shown in FIG. 15, the heights 166 of ribs 110 can decrease moving forward along footbed element 108 from rearward heel portion 125. Further, base widths 172 of the grooves 117 interposed between ribs in heel portion 280 can also decrease moving from rearward heel portion 125 forward along footbed element 108. As such, the spacing between ribs in heel portion 280 can decrease moving forward along footbed element 108 from rearward heel portion 125. In addition, the angle of inclination 202 of the ribs can increase moving forward along footbed element 108 from ribs being generally angled forward to ribs that are generally oriented perpendicular to the outsole 106 in an area below the heel of the user's forefoot. Geometric changes to the ribs and grooves along the footbed can occur gradually as desired to provide a ribbed footbed having smooth geometric transitions for the foot.

Similar to the forefoot region 200 with respect to the ball of the foot, such a configuration of comparatively shorter, closer spaced, and generally perpendicular or slightly forwardly angled ribs 110 beneath the heel of the user's foot can provide various advantages—particularly for long term use of the article of footwear. For example, ribs of shorter height can have greater column strength than taller ribs and can better support the foot and attenuate impacts at a position of concentrated weight-bearing below the heel of the user's foot. Likewise, closely spaced, thinner ribs at the same location can provide a tightly-packed bed of support ribs for improved impact attenuation and support beneath the heel of the foot. Slightly angling the ribs forward beneath the heel of the foot and angling the ribs forward to a greater degree behind the heel can provide improved support for the heel as the user walks.

Figure 14:
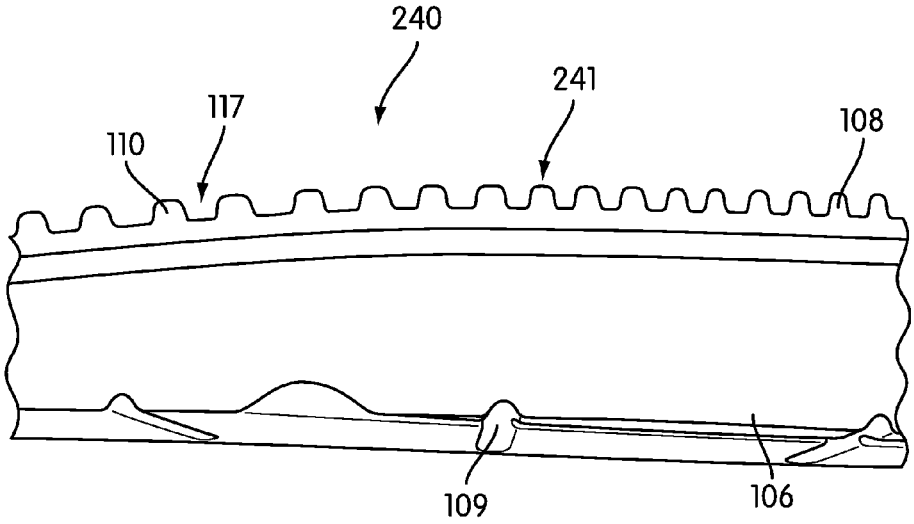

Referring now to FIGS. 9, 10 and 14, an arch portion 240 of ribbed element 108 is disposed in a middle portion of ribbed element 108 in a region generally corresponding with the arch of the user's foot during use. As shown in FIG. 14, the heights 166 of ribs 110 can be highest at a middle portion 241 of the arch region and decrease moving forward and rearward along footbed element 108 away from middle portion 241. Further, base widths 172 of the grooves 117 interposed between ribs in arch portion 240 can also decrease moving away from middle portion 241 forward along footbed element 108. As such, the spacing between ribs in arch portion 240 can decrease moving rearward and forward along footbed element 108 away from middle portion 241.

Such a configuration of comparatively short, thick and more widely spaced ribs 110 beneath the arch of the user's foot can provide various advantages—particularly for long term use of the article of footwear. For example, ribs of shorter height can have greater column strength than taller ribs and can better support the foot and attenuate impacts at a position of concentrated weight-bearing below the heel of the user's foot. Likewise, thicker, wider spacer ribs at the same location can provide a resilient framework of support ribs for maintaining support under the user's arch along with more gradual impact attenuation that beneath the ball and heel of the foot where impacts are typically greater.

Figure 13:
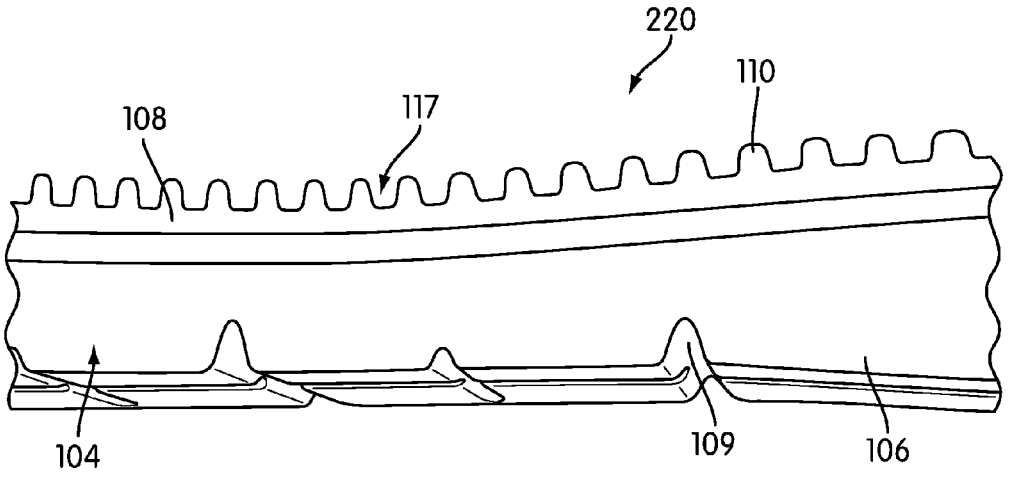

Referring now to FIGS. 9, 10, 13 and 15, a forward intermediate portion 220 (FIG. 13) and a rearward intermediate portion 260 (FIG. 15) of ribbed element 108 are disposed fore and aft respectively of arch 240. As shown in FIGS. 13 and 15, the heights 166 and base widths 158 of ribs 110, and the base widths 172 of the grooves 117 interposed between adjacent ribs can change moving along the footbed to smoothly transition between forefoot portion 200 and arch portion 260 (forward intermediate portion 220) or between arch portion 240 and heel portion 280 (rearward intermediate portion 260).

Figure 5:
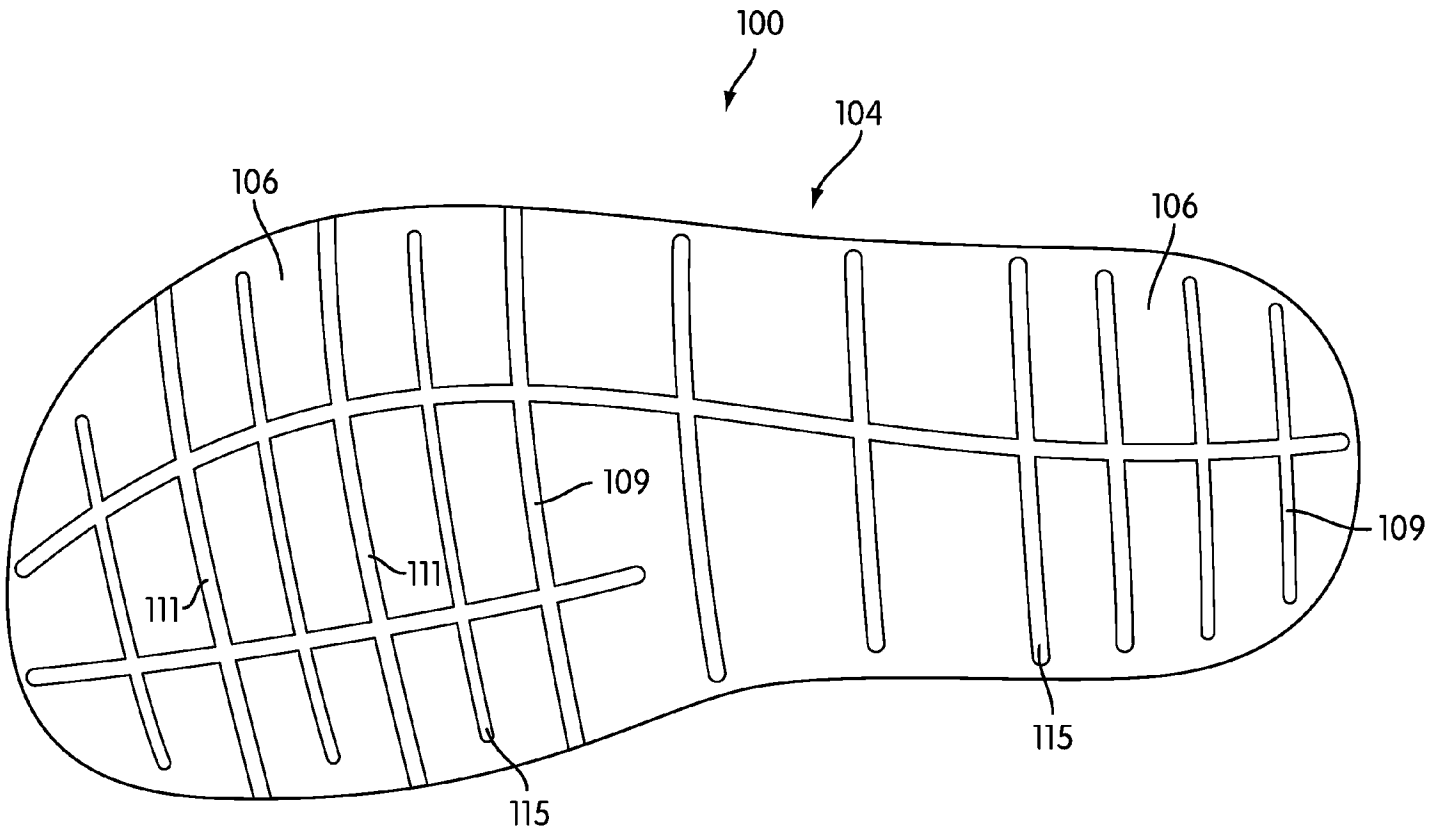
FIG. 5 is a bottom view of an example article of footwear having a ribbed footbed.
Figure 6:
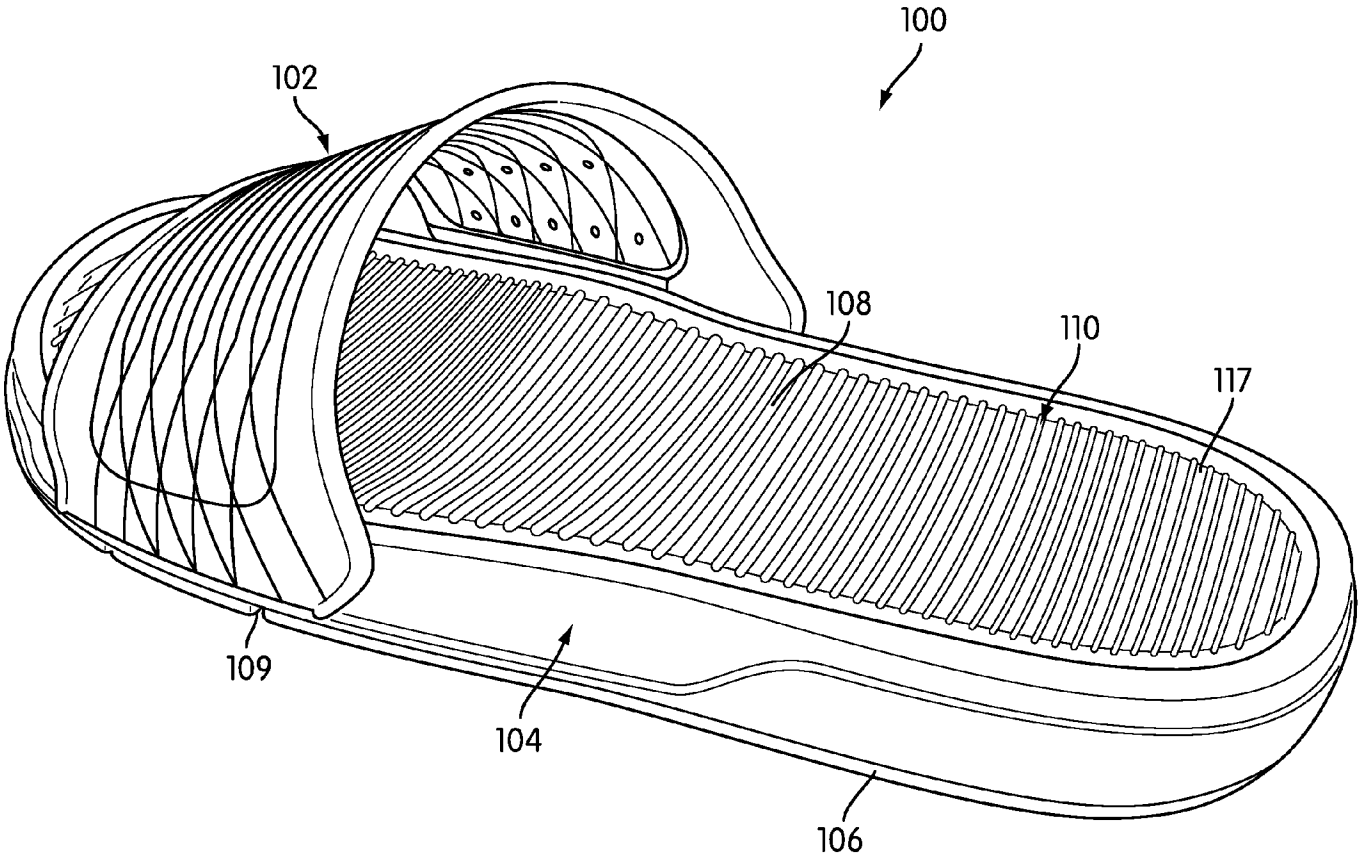
FIG. 6 is a rear lateral perspective view of an example article of footwear having a ribbed footbed.
Figure 7:
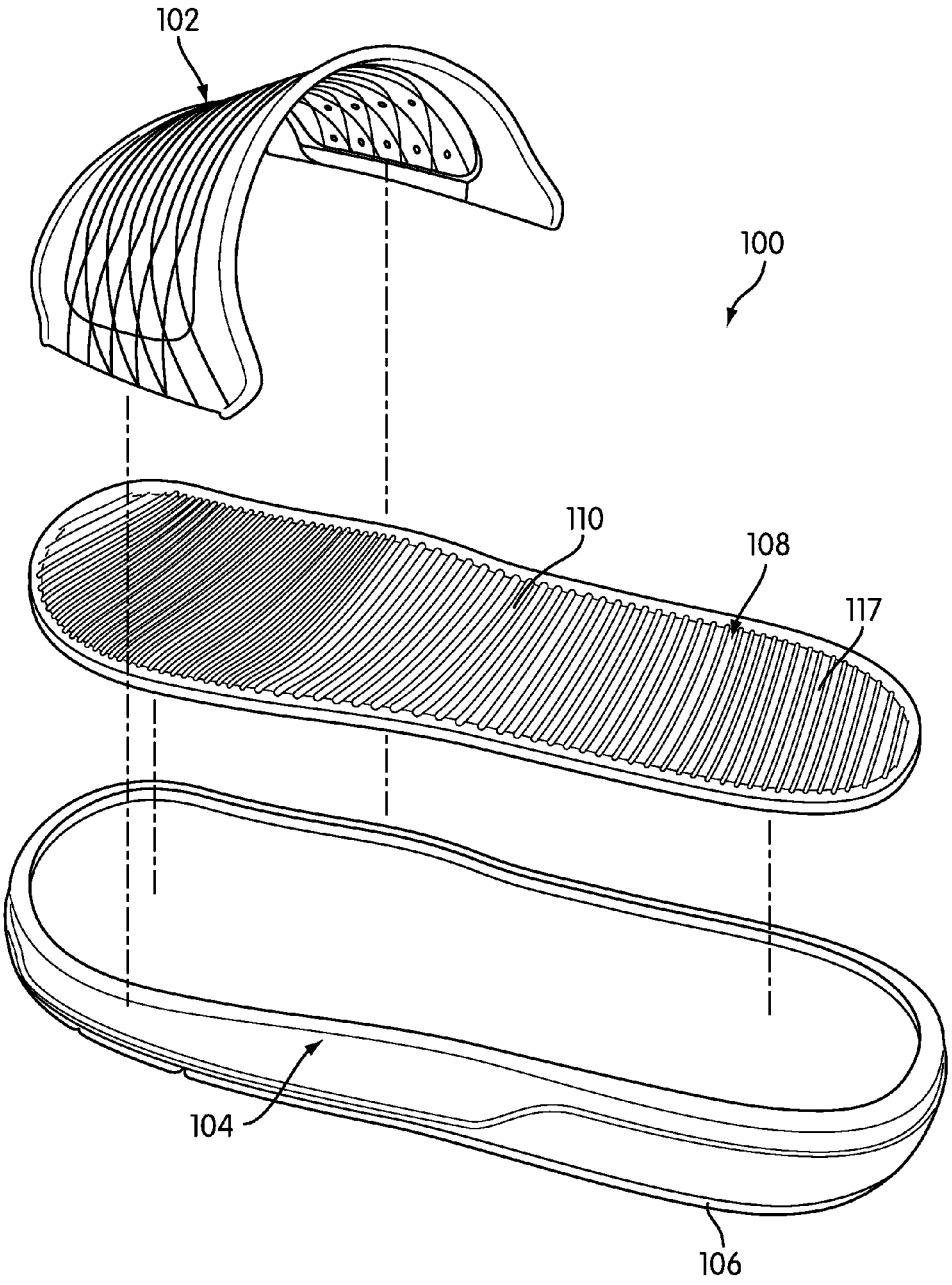
FIG. 7 is an exploded view of an example article of footwear having a ribbed footbed.
Figure 8:
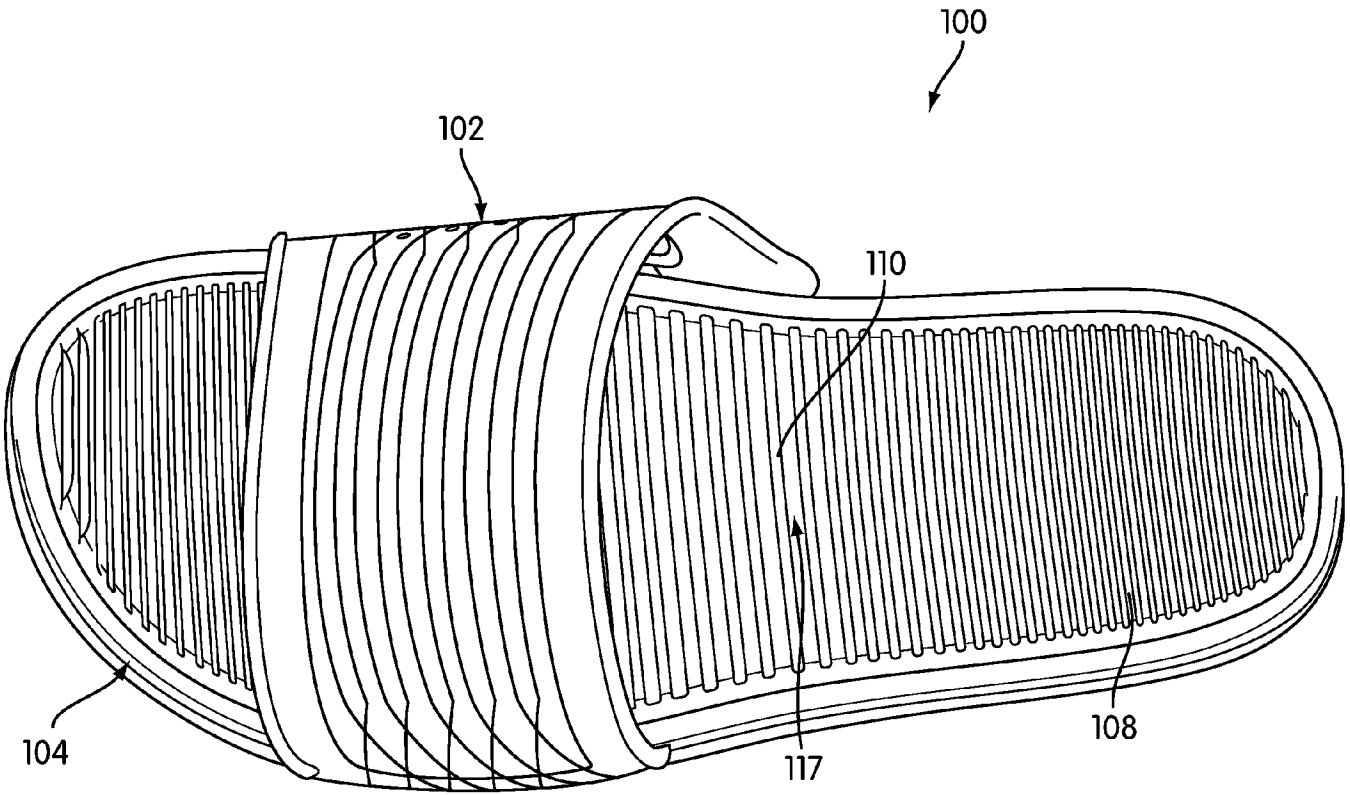
FIG. 8 is a top view of an example article of footwear having a ribbed footbed.

Referring now to FIGS. 5 and 10, outsole 106 can include features that can cooperate with features of ribbed element 108 to provide further advantages. For example, some configurations can include treads 109 at the outsole arranged as generally lateral channels 109 formed in the outsole. The lateral channels 109 can include primary hinge channels 111 in the form of relatively deep channels configured to form a living hinge in sole 104 to encourage bending proximate hinge channels 111, as well as secondary hinge channels 115 in the form of more shallow channels than the primary channels, which can encourage flexion proximate the secondary hinge channels without creating a living hinge or encouraging significant bending thereat. The primary hinge channels 111 can be formed as V or wedge-shaped cutouts 111 in the outsole that encourage the outsole to bend proximate an apex portion of the cutout when outsole 104 bends or curls downward. Lateral channels 109 can be arranged at desired flex locations in various configurations of primary channels 111 and secondary channels 115 to encourage bending, such as opposite forefoot portion 200 of ribbed element 108. As such, hinge channels 111 can cooperate with the arrangement of ribs and grooves in the ribbed element 108 to further enhance the flexibility of sole 104 for bending in desired directions.

While various configurations of the invention have been described, the description is intended to be exemplary, rather than limiting and it will be apparent to those of ordinary skill in the art that many more configurations and implementations are possible that are within the scope of the invention. Accordingly, the invention is not to be restricted except in light of the attached claims and their equivalents. Also, various modifications and changes can be made within the scope of the attached claims.

What is claimed is:

1. An article of footwear comprising:

a sole comprising an outsole and a footbed element configured to support a foot away from the outsole;

a set of transverse ribs formed on the footbed element, the set of transverse ribs extending from a forefoot end portion of the sole to a heel end portion of the sole, wherein the transverse ribs comprise:

a forefoot set of transverse ribs having a first geometry and being disposed in a forefoot region of the footbed element, the first geometry having a first plurality of rib heights, a first plurality of base widths and a first plurality of spacings between adjacent ribs;

a heel set of transverse ribs disposed in a heel region of the footbed element having a second geometry, the second geometry having a second plurality of rib heights, a second plurality of base widths and a second plurality of spacings between ribs; and an arch set of transverse ribs disposed in an arch region of the footbed element, the arch region being disposed between the forefoot region and the heel region, the arch set of transverse ribs having a third geometry that differs from the first geometry and also differs from the second geometry, the third geometry having a third plurality of rib heights, a third plurality of base widths and a third plurality of spacings between ribs, wherein the article of footwear includes a rearward direction extending from the forefoot end portion of the sole towards the heel end portion of the sole and a forward direction extending from the heel end portion of the sole towards the forefoot end portion of the sole, and wherein at least one of:

(i) the first plurality of rib heights decreases in the rearward direction from a forefoot end of the footbed element, the second plurality of rib heights decreases in the forward direction from a heel end of the footbed element, and the third plurality of rib heights decreases in the forward direction and in the rearward direction from approximately a midpoint of the arch region of the footbed element;

(ii) the first plurality of base widths decreases in the rearward direction from the forefoot end of the footbed element, the second plurality of base widths decreases in the forward direction from the heel end of the footbed element, and the third plurality of base widths decreases in the forward direction and in the rearward direction from approximately the midpoint of the arch region of the footbed element; or (iii) the first plurality of spacings between ribs decreases in the rearward direction from the forefoot end of the footbed element, the second plurality of spacings between ribs decreases in the forward direction from the heel end of the footbed element, and the third plurality of spacings between ribs decreases in the forward direction and in the rearward direction from approximately the midpoint of the arch region of the footbed element.

2. The article of footwear according to claim 1, wherein each of the transverse ribs extends across the footbed element from a lateral edge of the footbed element to a medial edge of the footbed element.

3. The article of footwear according to claim 1, wherein the outsole includes a bottom surface for contacting the ground and an opposite footbed surface, wherein the footbed surface defines a cavity, and wherein the footbed element is separately formed and is configured to fit within the cavity.

4. The article of footwear according to claim 1, further comprising a first intermediate set of transverse ribs disposed between the forefoot set of transverse ribs and the arch set of ribs, the first intermediate set of transverse ribs having a fourth geometry that provides a smooth transition between the first geometry and the third geometry.

5. The article of footwear according to claim 4, wherein the fourth geometry gradually changes from being substantially the same as the first geometry proximate the forefoot set of transverse ribs to being substantially the same as the third geometry proximate the arch set of transverse ribs.

6. The article of footwear according to claim 4, further comprising a second intermediate set of transverse ribs disposed between the heel set of transverse ribs and arch set of transverse ribs, the second intermediate set of transverse ribs having a fifth geometry that provides a smooth transition between the second geometry and the third geometry.

7. The article of footwear according to claim 6, wherein the fifth geometry gradually changes from being substantially the same as the third geometry proximate the arch set of transverse ribs to being substantially the same as the second geometry proximate the heel set of transverse ribs.

8. The article of footwear according to claim 1, wherein the first geometry differs from the second geometry.

9. The article of footwear according to claim 1, further comprising an upper connected to the sole, the upper and the sole forming open regions exposing a user's foot during use.

10. The article of footwear according to claim 1, wherein the set of transverse ribs is configured to resist bending of the sole along longitudinal axes generally oriented from the forefoot end portion of the sole to the heel end portion of the sole and to permit bending of the sole along transverse axes generally oriented from a lateral edge portion of the sole to a medial edge portion of the sole.

11. The article of footwear according to claim 10, wherein grooves are formed between adjacent ones of the transverse ribs and the transverse axes for bending are disposed with the grooves.

12. A footbed element for incorporating into an article of footwear, the footbed element comprising:

a bottom surface for incorporating into an outsole of the article of footwear; and a top surface opposite the bottom surface, the top surface having a set of transverse ribs extending from a forefoot end of the footbed element to a heel end of the footbed element, each of the ribs having a base width;

wherein the base widths of the ribs disposed in an arch region of the footbed element are greater than the base widths of the ribs and a plurality of grooves disposed in a forefoot region and a heel region of the footbed element, and wherein each of the ribs has a rib height, and wherein:

in the forefoot region, the rib heights are (i) highest at the forefoot end and (ii) decreasing toward the heel end;

in the heel region, the rib heights are (iii) highest at the heel end and (iv) decreasing toward the forefoot end; and in the arch region, the rib heights are (v) highest at a middle portion of the arch region and (vi) decreasing toward the forefoot end and the heel end.

13. The footbed element according to claim 12, wherein the set of transverse ribs are oriented to extend laterally from a lateral side edge of the footbed element to a medial side edge of the footbed element.

14. The footbed element of claim 12, wherein the rib heights and the base width of each of the transverse ribs change moving along the footbed element to smoothly transition from the forefoot region to the arch region to the heel region.

15. An article of footwear comprising:

an upper;

a sole connected with the upper, the sole having a footbed on an upper portion toward the upper and an outsole on an opposite lower portion;

a set of transverse ribs extending from a forefoot region to a heel region, the set of transverse ribs being oriented to extend laterally from a lateral side edge of the footbed to a medial side edge of the footbed and configured to be exposed to a wearer's foot, each of the ribs having a base width, wherein the base widths of the ribs disposed in an arch region of the footbed are greater than the base widths of the ribs and grooves disposed in the forefoot and heel regions; and a plurality of transverse treads formed in the outsole being oriented to extend laterally from a lateral side edge of the outsole to a medial side edge of the outsole, wherein the article of footwear includes a rearward direction extending from the forefoot region towards the heel region and a forward direction extending from the heel region towards the forefoot region, and wherein (i) the base widths of the ribs disposed in the forefoot region decrease in the rearward direction from a forefoot end of the footbed, (ii) the base widths of the ribs disposed in the heel region decrease in the forward direction from a heel end of the footbed, and (iii) the base widths of the ribs disposed in the arch region decrease in the forward direction and in the rearward direction from approximately a midpoint of the arch region of the footbed.

16. The article of footwear according to claim 15, further comprising a set of transverse grooves formed between adjacent transverse ribs, wherein the ribs and grooves proximate one or more of the transverse treads cooperate with the one or more transverse treads to form a live hinge in the sole, wherein the live hinge is configured to encourage bending of the sole in a longitudinal direction of the sole and resist bending in a transverse direction of the sole.

* * * * *